United States Patent [19]

Fujikawa et al.

[11] Patent Number: 4,776,830

[45] Date of Patent: Oct. 11, 1988

[54] PACKAGING MACHINE

[75] Inventors: Yasuji Fujikawa; Yoshihiro Saijo; Tadaaki Kume, all of Tokushima, Japan

[73] Assignee: Shikoku Kakooki Co., Ltd., Tokushima, Japan

[21] Appl. No.: 932,843

[22] Filed: Nov. 20, 1986

[30] Foreign Application Priority Data

Jul. 15, 1986 [JP] Japan ..... 61-108811[U]

[51] Int. Cl.[4] ..... B31B 3/32; B31B 5/28

[52] U.S. Cl. ..... 493/133; 493/122; 493/125; 493/164; 493/183

[58] Field of Search ..... 493/122, 123, 124, 125, 493/126, 133, 163, 164, 165, 166, 183

[56] References Cited

U.S. PATENT DOCUMENTS

| | | | |
|---|---|---|---|
| 3,207,049 | 9/1965 | Monroe et al. | 493/164 |
| 3,486,423 | 12/1969 | Mistarz | 493/164 |
| 3,788,033 | 1/1974 | Martensson et al. | 493/133 |
| 3,943,834 | 3/1976 | Vetten | 493/164 |
| 4,391,083 | 7/1983 | Fox | 53/575 |
| 4,528,803 | 7/1985 | Ott | 53/563 |
| 4,581,004 | 4/1986 | Nagata | 493/164 |

*Primary Examiner*—Frederick R. Schmidt
*Assistant Examiner*—William E. Terrell
*Attorney, Agent, or Firm*—Armstrong, Nikaido, Marmelstein & Kubovcik

[57] ABSTRACT

A packaging machine including a rotor having a plurality of radial mandrels each for carrying a container as fitted therearound and intermittently drivingly rotatable so that the mandrels successively stop at processing stations equal in number to the number of the mandrels, a container bottom breaker provided at one of the processing stations, and a container holding device provided at the same processing station as the container bottom breaker and having at least one container pressing member to be pressed against the mandrel at rest at said same processing station over the container fitted around the mandrel.

8 Claims, 7 Drawing Sheets

PACKAGING MACHINE

BACKGROUND OF THE INVENTION

The present invention relates to a packaging machine, and more particularly to a machine which comprises a rotor having radial mandrels and in which containers supplied to the rotor are each folded flat and closed at one end to form a bottom while the container is being transported as fitted around each mandrel.

When the end of the container is closed as stated above, the container is subjected to a force acting thereon longitudinally of the mandrel and must therefore be restrained from moving along the mandrel by holding means. Such means heretofore known include, for example, a stopper provided on the mandrel for holding the container by contact therewith.

In the field of packaging machines of the type described, the height of containers is often changed to obtain containers of different capacities. However, it is very cumbersome to adjust the position of the stopper relative to the mandrel in corresponding relation to the desired height every time the height of containers is to be altered.

SUMMARY OF THE INVENTION

The main object of the present invention is to provide a packaging machine wherein containers of varying heights can be held to the mandrel without necessitating such an adjusting procedure.

The present invention provides a packaging machine which comprises a rotor having a plurality of radial mandrels each for carrying a container as fitted therearound and intermittently drivingly rotatable so that the mandrels successively stop at processing stations equal in number to the number of the mandrels, a container bottom breaker provided at one of the processing stations, and container holding means provided at the same processing station as the container bottom breaker and having at least one container pressing member to be pressed against the mandrel at rest at said same processing station over the container fitted around the mandrel. According to the invention, containers of different heights can be held to each mandrel without necessitating any adjustment.

Embodiments of the present invention will be described below with reference to the accompanying drawings for illustrative purposes only.

DESCRIPTION OF THE PREFERRED EMBODIMENTS

Figure 1:
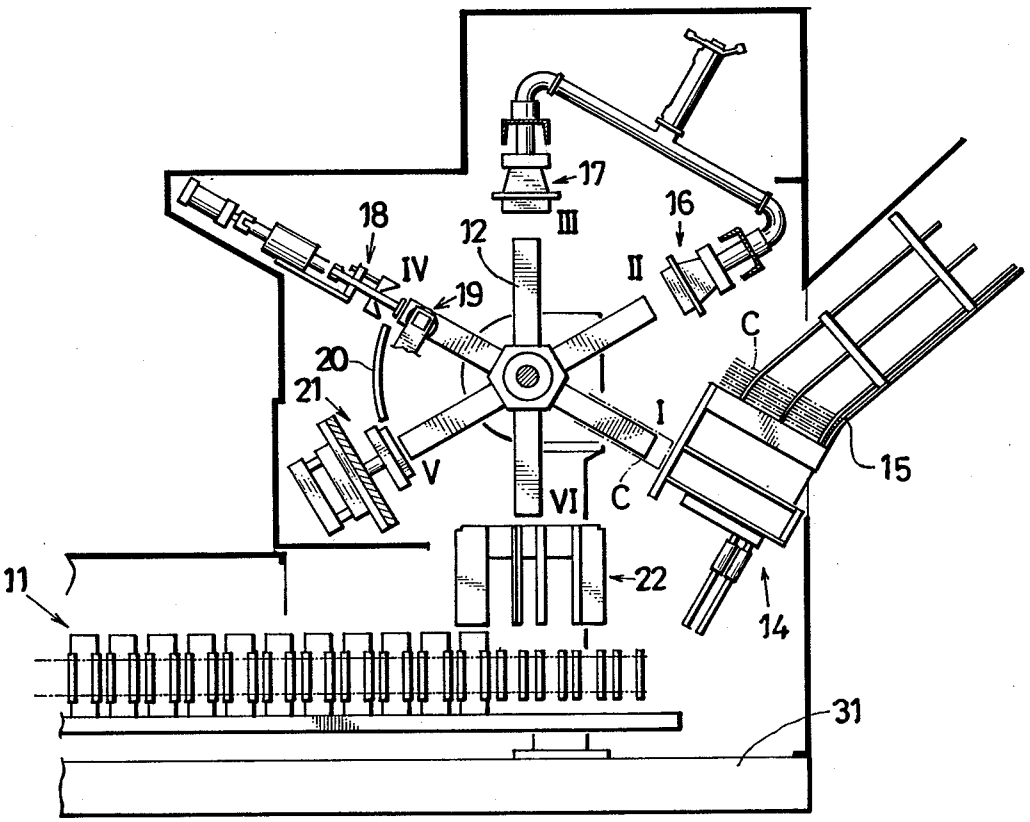
FIG. 1 is a side elevation of part of a packaging machine showing a rotor and devices around the rotor.

The packaging machine shown in FIG. 1 comprises a rotor 13 disposed above the starting end of the path of transport by a container conveyor 11 and having six radial mandrels 12. The rotor 13 is intermittently driven by unillustrated means so that the mandrels 12 successively stop at six processing stations, i.e., first to sixth processing stations I to VI. Of these stations I to VI, the sixth station VI is the position where the mandrel 12 stops as oriented vertically downward. The first to sixth stations I to VI are arranged in the direction of rotation of the rotor 13 (counterclockwise direction in FIG. 1). A container feeder 14 is provided at the first processing station I. The container feeder 14 has a magazine 15 accommodating a stack of containers C which are folded flat so as to be shaped to the form of a square tube. The container C is delivered from the feeder 14 while being unfolded into a square tube and fitted around the mandrel 12 which is at rest at the first processing station I. In this state, the container C has projected from the mandrel 12 the portion to be made into its bottom. Primary and secondary container bottom heaters 16 and 17 for successively heating the portion to be formed into the container bottom are arranged at the second and third processing stations II and III, respectively. Provided at the next fourth processing station IV are a container bottom beaker 18 for folding the bottom portion flat and means 19 for holding the container C to the mandrel 12 and preventing the container from moving longitudinally of the mandrel during folding. A container bottom guide rail 20 extends from the fourth processing station IV to the fifth V for maintaining the container bottom portion in the flat folded state made by the bottom breaker 18 and holding the portion pressed to a flatter state. Disposed at the fifth processing station V is a container bottom sealing unit 21 for pressing the flat folded bottom portion and cooling the portion to close the bottom. A container discharge unit 22 is provided at the last sixth processing station VI, whereby the tubular container with the closed bottom is removed from the mandrel 12 and delivered to the container conveyor 11. Although not shown, a group of devices are arranged along the path of travel of the conveyor 11 for filling contents into the containers being transported by the conveyor 11 and thereafter folding the top portion of each container into the shape of a gabled roof for closing.

Of the devices described above, those other than the container bottom breaker 18 and the container holding means 19 are well known and will not be described in detail.

Figure 2:
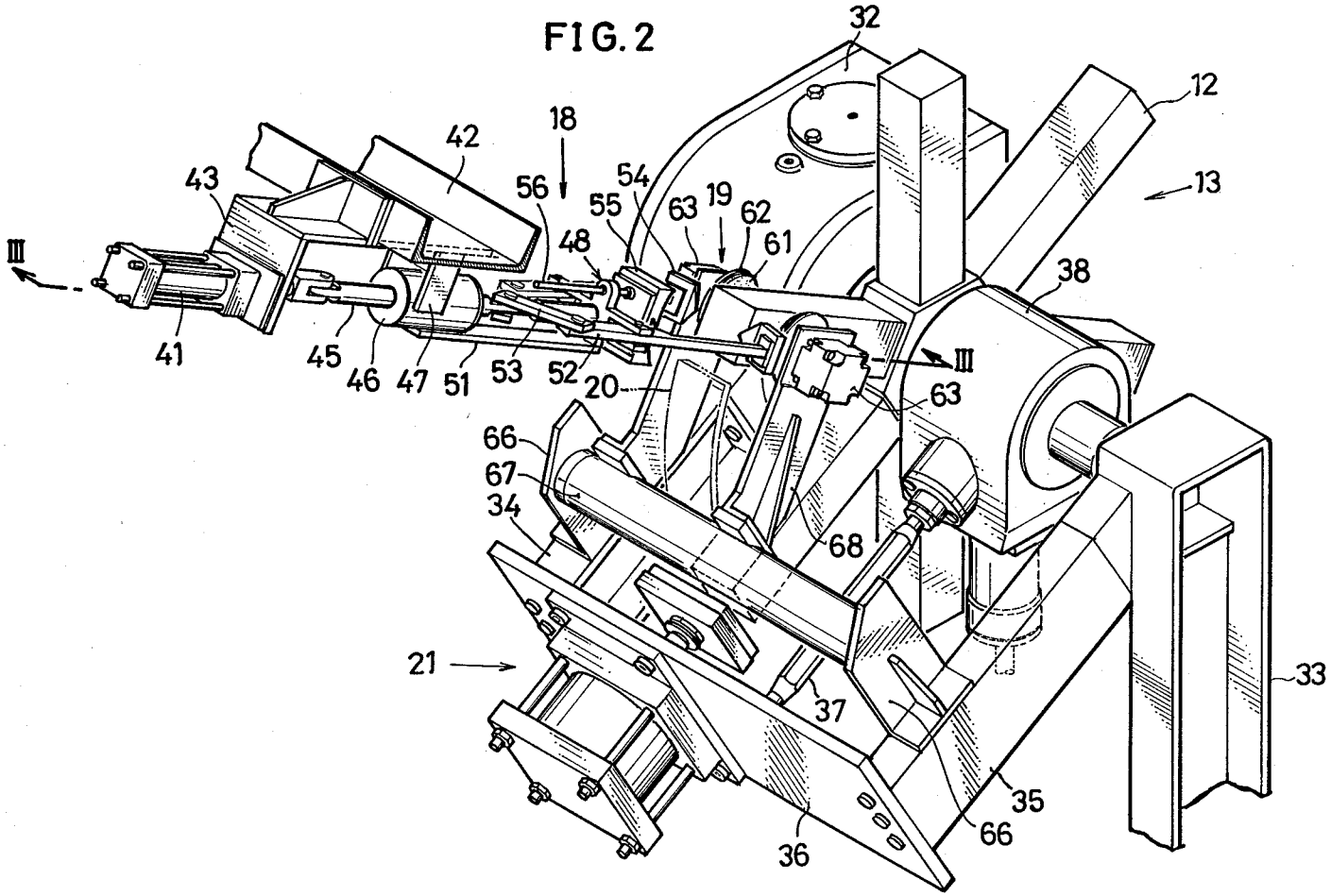
FIG. 2 is a fragmentary perspective view showing the same on an enlarged scale.

With reference to FIG. 2, two stands 32, 33 are provided on a bed 31 (shown in FIG. 1) at opposite sides of the path of transport by the container conveyor 11. The rotor 13 is supported by the stands 32, 33 at the opposite sides of the path of movement of the mandrels 12. The stands 32, 33 are provided with support arms 34, 35 extending obliquely downward in parallel with each other from the upper ends of the stands 32, 33 so as to be positioned in parallel with the mandrel 12 when the mandrel is at rest at the fifth processing station V. The support arms 34, 35 have their base ends fixed to the upper ends of the stands 32, 33 and their forward ends positioned at opposite sides of the container bottom sealing unit 21. The sealing unit 21 is mounted on a support plate 36 fixed to and interconnecting the forward ends of the support arms 34, 35. A connecting rod 37 is connected at its one end to the support plate 36 at one side of the sealing unit 21. The connecting rod 37 extends in parallel with the support arms 34, 35 and has the other end thereof connected to a gear case 38 mounted on the rotor 13. Although not shown, the gear case 38 houses gears for taking off the torque of the rotor 13.

Figure 3:
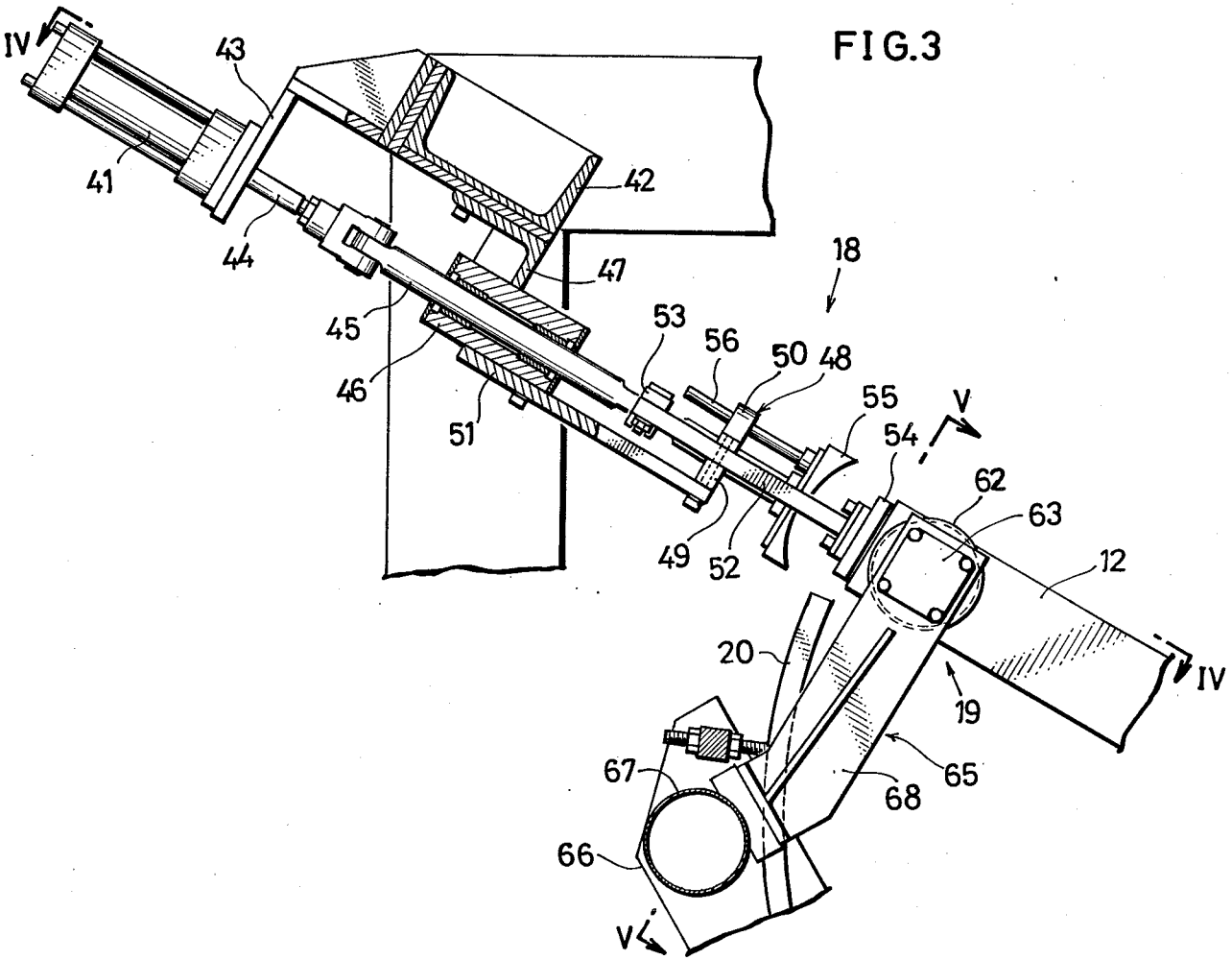
FIG. 3 is a view in section taken along the line III—III in FIG. 2.
Figure 4:
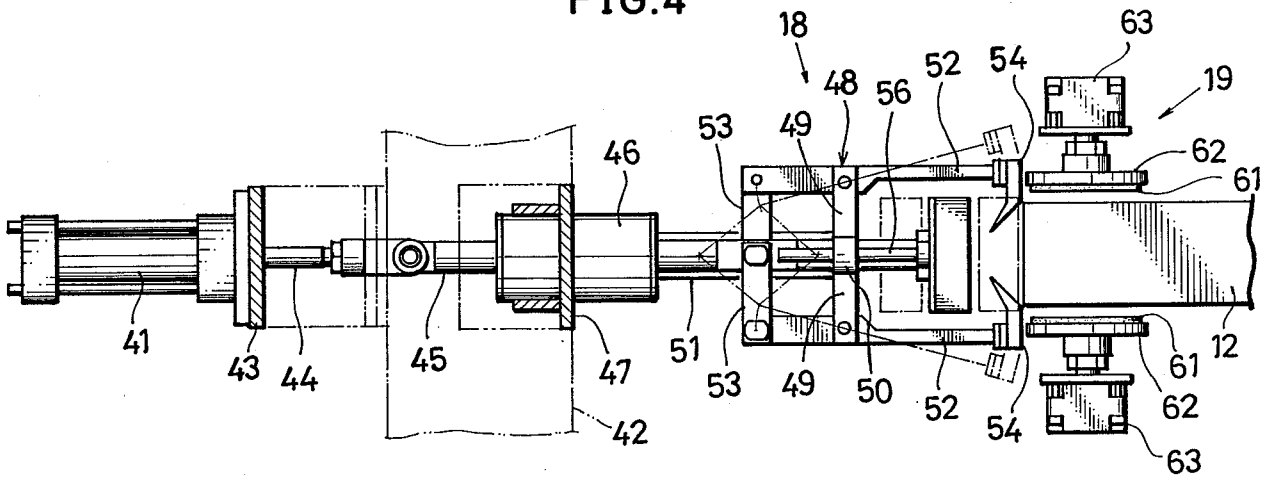
FIG. 4 shows the same arrangement as FIG. 3 as it is seen in the direction of the arrows IV—IV therein.

With reference to FIGS. 3 and 4, the container bottom breaker 18 has an air cylinder 41 oriented inward in alignment with the mandrel 12 when the mandrel 12 is at rest at the fourth processing station IV. The air cylinder 41 is attached to a beam 42 of the frame of the machine by a bracket 43. The air cylinder 41 has a piston rod 44 which is connected to a rod 45 movable forward and rearward. A slide guide sleeve 46 is fitted around the movable rod 45 at a portion thereof toward its outer end and is suspended from the beam 42 by a bracket 47. A yoke 48 is fittingly mounted on the movable rod 45 at a position toward the rod inner end so as to permit free movement of the rod 45. The yoke 48, which is generally T-shaped when seen from the front, has two first arms 49 extending from the rod 45 away from each other and one second arm 50 perpendicular to the first arms 49. The junction of these first and second arms 49, 50 is connected to the slide guide sleeve 46 by a rod 51. A lever 52 is supported, at an intermediate portion of its length, by the free end of each first arm 49. The outer ends of the levers 52 are connected to the movable rod 45 by a pair of links 53. A first folding member 54 is attached to the inner end of each lever 52. The two first folding members 54 project from the inner ends of the levers 52 toward each other and each has an inward tapered acting portion. A second folding member 55 is attached to the inner end of the movable rod 45. The second folding member 55 is in the form of a generally square plate when seen from the front and has a retaining rod 56 attached to its outer surface perpendicular thereto and extending through the second arm 50 of the yoke 48. The second folding member 55 has an inward acting surface which is curved in the form of a recess.

FIGS. 3 and 4 show the piston rod 44 of the air cylinder 41 as positioned between the advanced limit position and the retracted limit position of its stroke. In this state, the two levers 52 are parallel with the movable rod 45, and the two links 53 are perpendicular to the movable rod 45. When the piston rod 44 is either advanced or retracted from this state, the movable rod 45, which moves with the piston rod 44, causes the pair of links 53 to draw the outer ends of the two levers 52 toward each other, pivotally moving the two levers 52 in directions opposite to each other and moving the first folding members 54 at their inner ends away from each other to open these members as shown in broken lines in FIG. 4. On the other hand, the second folding member 55 moves with the movable rod 45 with the advance or retraction of the piston rod 44.

The portion of the container to be made into its bottom is folded in the following manner. First, the piston rod 44 of the air cylinder 41 is retracted to open the first folding members 54. In this state, the rotor 13 is driven by one pitch to bring the above-mentioned portion of a container to the position between the first folding members 54, whereupon the piston rod 44 is advanced. As the piston rod 44 moves forward, the two folding members 54 move toward each other from the opened position. When the rod 44 reaches the midpoint of its stroke, the two first folding members 54 are closed, inwardly folding one of two pairs of opposed rectangular panels of the container bottom forming portion between the other pair. As the piston rod 44 further advances, the first folding members 54 move away from each other. With this movement, the second folding member 55 moves inward, inwardly folding the other pair of rectangular panels over the first pair of panels folded by the first folding members 54 when the piston rod 44 reaches the advanced limit position. The rotor 13 is then driven by one pitch, whereby the container is sent to the bottom sealing unit 21 with its bottom forming portion held folded by the guide rail 20. While the container is thus fed to the unit 21, the piston rod 44 is completely retracted and made ready to fold another container.

Figure 5:
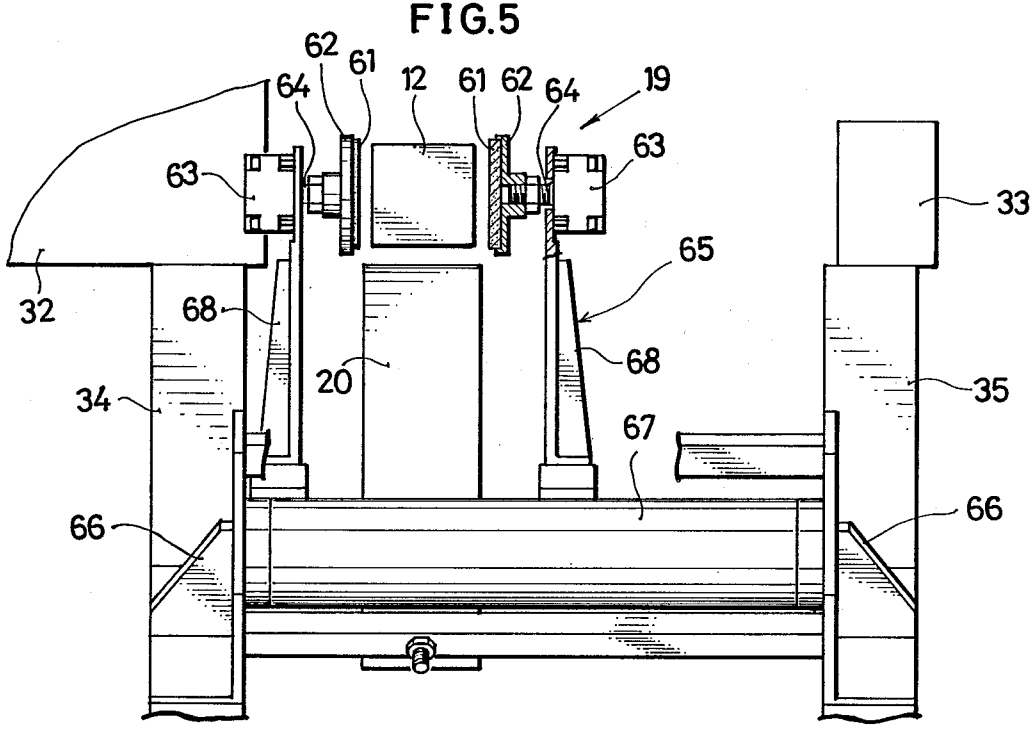
FIG. 5 is a view in section taken along the line V—V in FIG. 3.

With reference to FIG. 5, the container holding means 19 comprises two container pressing members 61 arranged at opposite sides of the path of movement of the mandrels 12. When the mandrel 12 is at rest at the fourth processing station IV, the two pressing members 61 are pressed against the mandrel 12 over the container C fitted therearound. Each of the pressing members 61 is made of an elastomeric material such as silicone rubber and fitted to a shallow dish-shaped holder 62, which is attached to the piston rod 64 of a thin air pressure operated cylinder 63. The two cylinders 63 are supported by a support frame 65, opposed to each other and each positioned horizontally at one side of the corresponding pressing member 61 opposite to the other side thereof facing the path of movement of the mandrels 12. The support frame 65 comprises a pair of first brackets 66 extending upward from the support arms 34, 35 and positioned toward the forward arm ends, a horizontal member 67 interconnecting the upper ends of these brackets 66, and a pair of second brackets 68 attached to the horizontal member 67 and spaced apart longitudinally thereof. The cylinders 63 are mounted on these second brackets 68.

Before the container bottom breaker 18 performs a folding operation, the piston rods 64 of the two thin air cylinders 63 are in retracted position. When the rotor 13 is driven by one pitch in this state, the container C having the portion to be folded and fitted over one of the mandrels 12 is fed to the fourth processing station IV and thereby positioned in the space between the two pressing members 61. The piston rods 64 of the air cylinders 63 are then advanced, whereby the two pressing members 61 are pressed against opposite sides of the mandrel 12 over the container C. The container C is subsequently folded by the bottom breaker 18 while being thus held in place without the likelihood of moving longitudinally of the mandrel 12.

Figure 6:
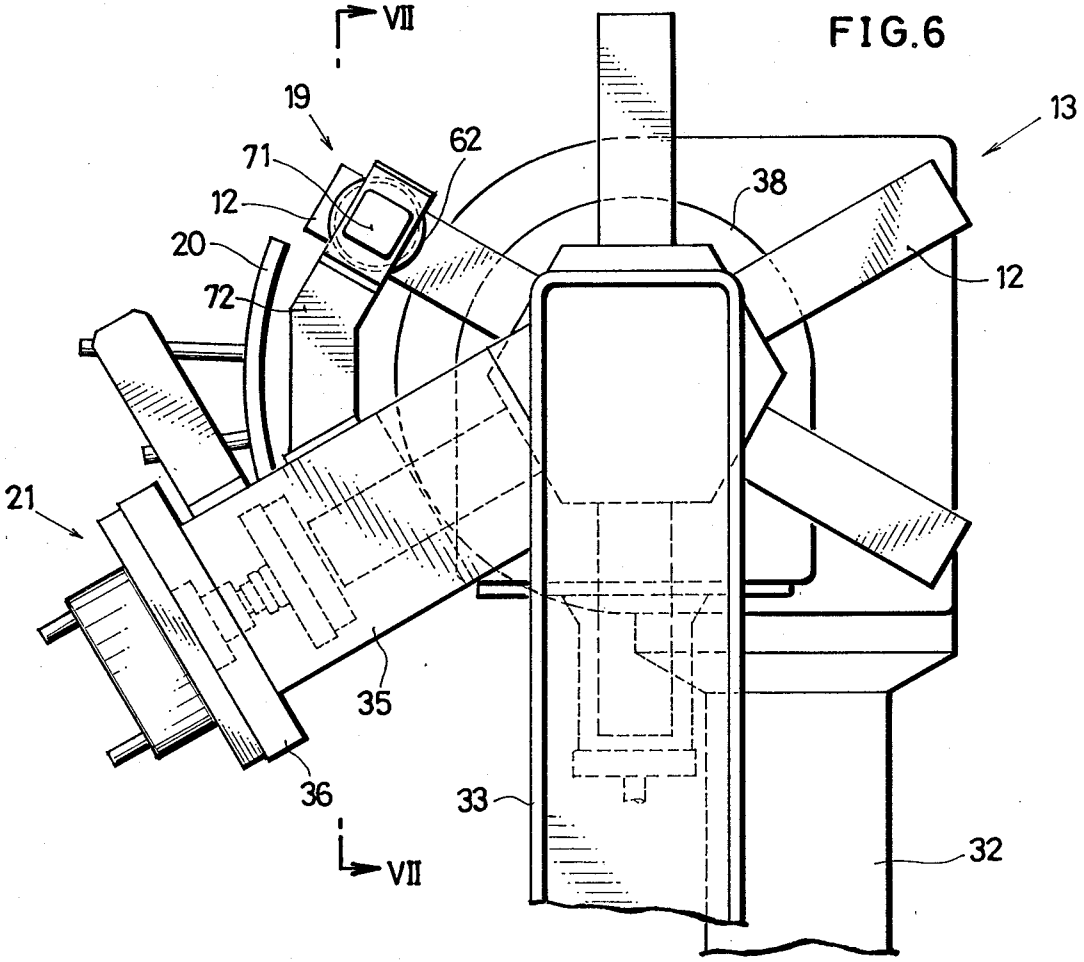
FIG. 6. is a side elevation corresponding to a portion of FIG. 1 and showing another embodiment.
Figure 7:
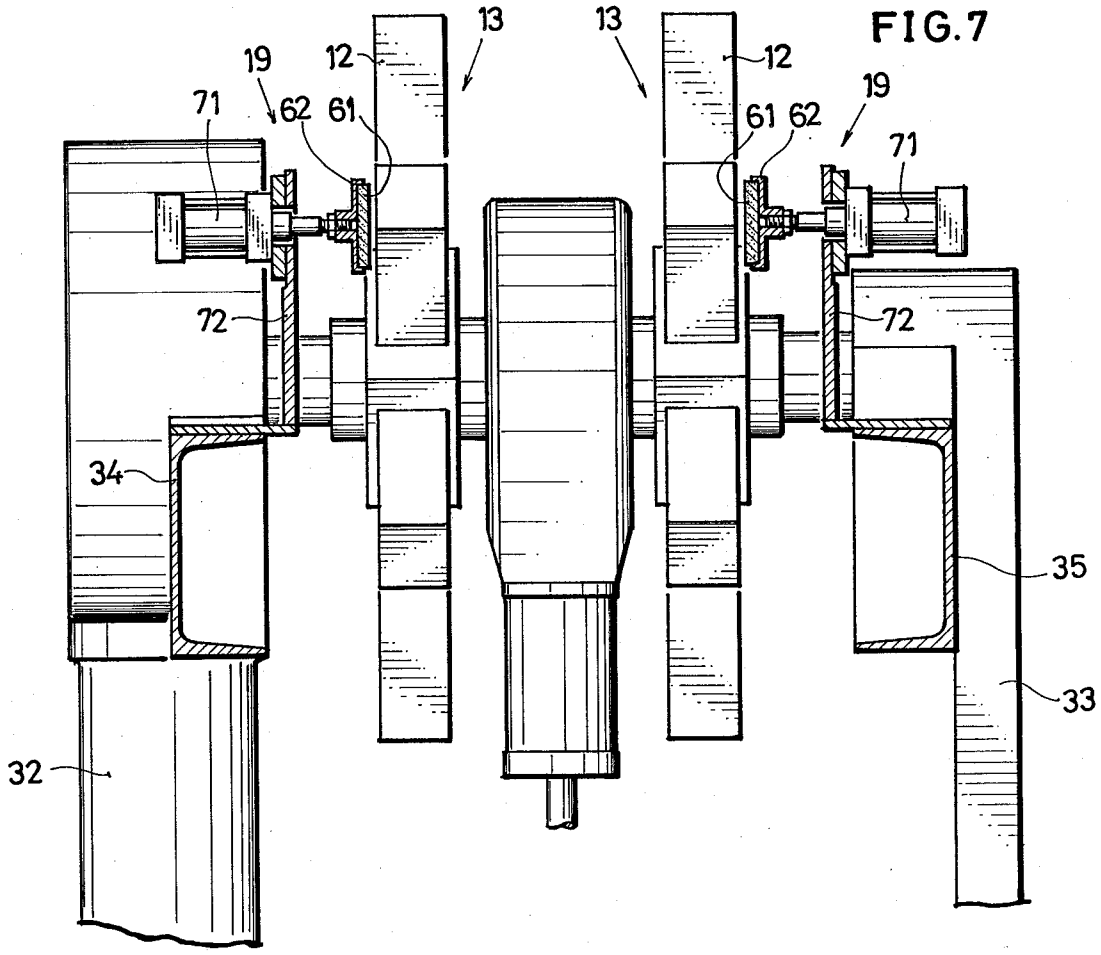
FIG. 7 is a view in section taken along the line VII—VII in FIG. 6.

While the foregoing embodiment includes two container pressing members for one mandrel positioned at the fourth processing station IV, FIGS. 6 and 7 show another embodiment wherein one container pressing member 61 is provided for one mandrel at the station IV. With reference to these drawings, two rows of mandrels 12 are provided, and one pressing member 61 is provided for each of mandrels 12. The pressing member 61 is operated by a hydraulic pressure operated cylinder 71 which may be the same as the cylinder 63 used above or an elongated one as illustrated if the pressure is insufficient. The cylinder 71 is supported only by a bracket 72 attached to the support arm 34 or 35.

What is claimed is:

1. A packaging machine comprising:

a machine bed having a frame and a plurality of processing stations, one of said processing stations being a bottom breaking station;

a rotor having a plurality of radial mandrels each for carrying a container fitted therearound, said mandrels being equal in number to said plurality of processing stations and being intermittently drivingly rotatable in a path so as to stop at each of said processing stations;

a container bottom breaker provided at said bottom breaking station for performing an operation of folding the bottom portion of a container flat, said bottom breaker including a pressure operated cylinder mounted on said packaging machine and acting longitudinally of said mandrels upon said bottom portion whereby said folding operation subjects said container to a force acting longitudinally thereon; and container holding means provided at said bottom breaking station comprising at least one other pressure operated cylinder mounted on said packaging machine so as to apply pressure transversely of said mandrels and including a pressing member facing the path of movement of said mandrels so as to be pressed against said container at a side of a mandrel stopped at said bottom breaking station, said container holding means cylinder being controlled by application of pressure thereto to press said pressing member against said container when said mandrel is at rest at said bottom breaking station before said bottom breaker cylinder operates to perform a folding operation on said container to prevent longitudinal movement of said container on said mandrel due to said longitudinally acting force.

2. A packaging machine as defined in claim 1 wherein the container holding means has two cylinders and pressing members opposed to each other and arranged on opposite sides of the path of movement of the mandrels.

3. A packaging machine as defined in claim 2 wherein said container pressing members are each attached to piston rods of said pressure operated cylinders, and the cylinders are each mounted on the frame of the machine and positioned at respective sides of the container pressing members opposite to the sides thereof facing the path of movement of the mandrels.

4. A packaging machine as recited in claim 3 wherein the container pressing members are composed of an elastomeric material.

5. A packaging machine as defined in claim 1 wherein said at least one other cylinder and pressing member is disposed at one side of the path of movement of the mandrels.

6. A packaging machine as defined in claim 5 wherein said at least one container pressing member is attached to a piston rod of said pressure operated cylinder, and the cylinder is mounted on the frame of the machine and positioned at a side of the container pressing member opposite to the side thereof facing the path of movement of the mandrels.

7. A packaging machine as recited in claim 6 wherein the container pressing member is composed of an elastomeric material.

8. A packaging machine comprising:

a machine bed having a plurality of processing stations;

a rotor having a plurality of radial mandrels equal in number to said processing stations, each for carrying a container fitted therearound and intermittently drivingly rotatable in a path so as to successively stop at each of said processing stations, the mandrels being oriented vertically downward when stopping at one of said processing stations;

said processing stations including a container feeder, a primary container bottom heater, a secondary container bottom heater, a container bottom breaker, a container bottom sealing unit and a container discharge unit arranged at separate processing stations, respectively;

a pair of stands positioned at opposite side of the path of movement of the mandrels and supporting the rotor;

a pair of support arms extending parallel with each other and having base ends fixed to the stands and forward ends positioned at opposite sides of the container bottom sealing unit;

a support plate fixed to and interconnecting the forward ends of the pair of arms and having the container bottom sealing unit mounted thereon; and container holding means disposed at the same processing station as the container bottom breaker, the container holding means comprising two container pressing members of elastomeric material arranged at opposite sides of the path of movement of the mandrels and positioned at opposite sides of a mandrel when at said bottom breaker processing station so as to be pressed against the container on the mandrel when the mandrel is at rest, two pressure operated cylinders opposed to each other and provided for the two pressing members, respectively, each with a piston rod attached to the pressing member, each of the cylinders being positioned horizontally at a side of the corresponding pressing member opposite to the side thereof facing corresponding pressing member opposite to the side thereof facing the path of movement of the mandrels, and an upwardly projecting support frame having the two hydraulic cylinders mounted thereon and bridging the pair of support arms.

* * * * *